United States Patent [19]
Hutchinson et al.
[11] 4,317,696
[45] Mar. 2, 1982

[54] APPARATUS FOR APPLYING PLASTIC TAPE

[75] Inventors: Robert S. Hutchinson, Montoursville; William L. Greiner, III, Muncy, both of Pa.

[73] Assignee: Prismo Universal Corporation, Montgomery, Pa.

[21] Appl. No.: 131,764

[22] Filed: Mar. 19, 1980

[51] Int. Cl.[3] ..... B32R 31/20; E01C 23/16
[52] U.S. Cl. ..... 156/523; 180/20; 404/94; 404/122
[58] Field of Search ..... 156/523, 525, 526; 404/72, 94, 122; 180/20

[56] References Cited

U.S. PATENT DOCUMENTS 4,030,958 6/1977 Stevemann ..... 156/523
4,162,862 7/1979 Harker et al. ..... 427/139

*Primary Examiner*—Caleb Weston
*Attorney, Agent, or Firm*—Cushman, Darby & Cushman

[57] ABSTRACT

An apparatus adapted for mounting adjacent the front pressure roller of a vehicle which applys plastic tape to pavement particularly to form highway marking patterns, with a horizontal plate having a slot through which plastic tape is advanced, a plurality of rollers driven by the pressure roller and engaging end advancing tape through the slot when a piston is actuated to move idler rollers to cause engagement of tape and rollers, a piston operated cutter beneath the plate and adjacent the slot and a guide chute for guiding the tape beneath the front roller.

14 Claims, 4 Drawing Figures

APPARATUS FOR APPLYING PLASTIC TAPE

The present invention relates to an improved apparatus for use with machines which apply plastic tape to pavement to form highway marking patterns.

Traditionally, white and colored stripes on pavement, particularly on highways, have been formed by pavement striping machines which spray paint onto the roadway. More recently, highway patterns, such as the stripes which divide lanes, have been formed with plastic tape which is applied to the pavement surface. Typically, such tape comes on a roll with adhesive material on one side which is covered by paper. The tape is mounted on a vehicle which is driven along the highway while one or more rolls of plastic tape are continuously unwound and the paper separated therefrom. The plastic tape is directed underneath a large roller which applies pressure thereto to cause the tape to adhere to the roadway. The patent to Harker et al U.S. Pat. No. 4,162,862 describes one machine of this type.

One of the difficulties with such machines is that of controlling the movement of the tape beneath the pressure roller and of producing highway marking patterns such as skip lines in which each length of tape is separated by a length of unmarked roadway.

The patent to Stenemann U.S. Pat. No. 4,030,958 describes an apparatus in which tape is pressed to the pavement by an engagement roller which can be retracted. A cutter adjacent the roller can cut the tape where desired. However, such an arrangement is mechanically complex and cannot be readily adapted to existing machines.

The present invention is an improved apparatus for use with vehicles which apply plastic tape as described above to a roadway. The apparatus is relatively simple and can be mounted on existing machines. According to the present invention, one or more rolls of tape are supplied to an apparatus mounted on the front of the machine adjacent the front pressure roller. A tape drive is mounted on a frame which can in turn be mounted on the front of the vehicle. A cutter is also mounted on the frame for cutting the tape when actuated. A tape guide mounted on the frame guides the tape between the pressure roller and the pavement.

In one embodiment the drive is controlled by the operator of the machine to advance one or more tapes to the large pressure roller when desired. The tape passes through a slot in a horizontal plate forming part of the frame and mounting the tape drive on the top thereof. A cutter is mounted beneath the plate and adjacent the slot for cutting the tape whenever a fluid operated piston is actuated to cause movement of a slide mounting a blade against a stationary blade. The drive preferably includes driving rollers driven by the pressure roller, and idler rollers which can be moved by a fluid operated piston to cause engagement and advance of the tape between the idler and driving rollers. A counter connected to a pulse generating circuit responsive to movement of the vehicle can be utilized to automatically operate the cutter piston in a given pattern or the piston can be operated manually by the operator of the device. A guide chute receives the tape after passage through the slot and provides a curved path for inserting the tape between the pavement and the pressure roller.

Other objects and purposes of the invention will be clear from the following detailed description of the drawings.

DETAILED DESCRIPTION OF THE DRAWINGS

Figure 1:
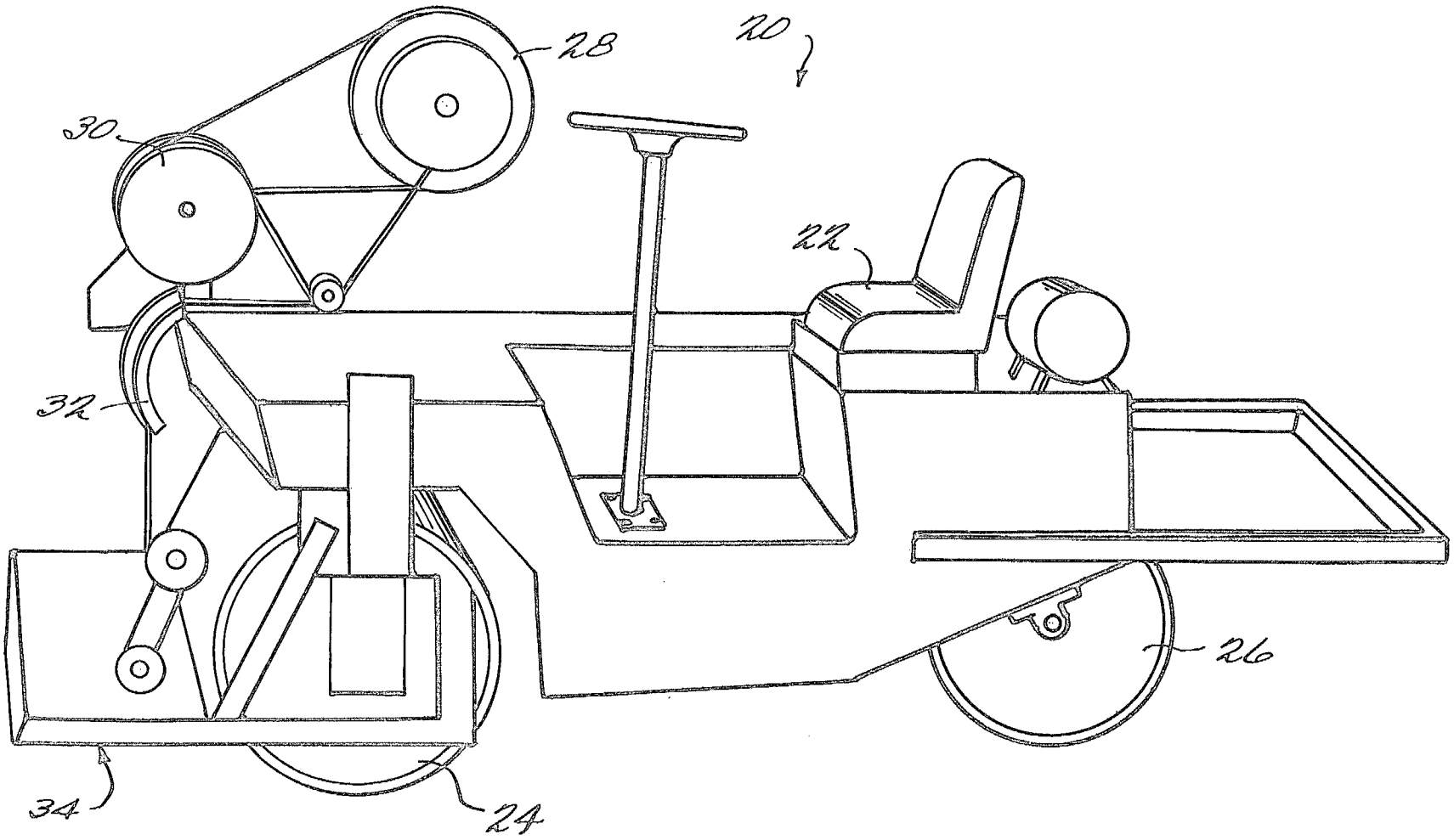
FIG. 1 shows a perspective view of the present invention mounted on a machine for applying plastic tape to a road surface.

Reference is now made to FIG. 1 which illustrates the present invention mounted on a vehicle generally indicated at 20 which applies one or more plastic tapes to a road surface to form a highway marking pattern. The vehicle 20 includes a body mounting a seat 22 for the operator and controls for operating the vehicle adjacent thereto. Vehicle 20 moves on a front pressure roller 24 and a rear roller 26. Plastic tape of the type which is conventionally available in rolls with a paper backing is dispensed from a roll 28 with the paper backing being wound around roller 30 as explained in the above-mentioned U.S. Pat. No. 4,162,862. Preferably two rolls of plastic tape are mounted adjacent to each other on roll 28 for simultaneous application to a road surface.

The tape which is dispensed from roll 28 passes around guide 32 with the adhesive side facing forward and to the present apparatus 34 which is mounted on the front of vehicle 20 adjacent front roller 24.

Figure 2:
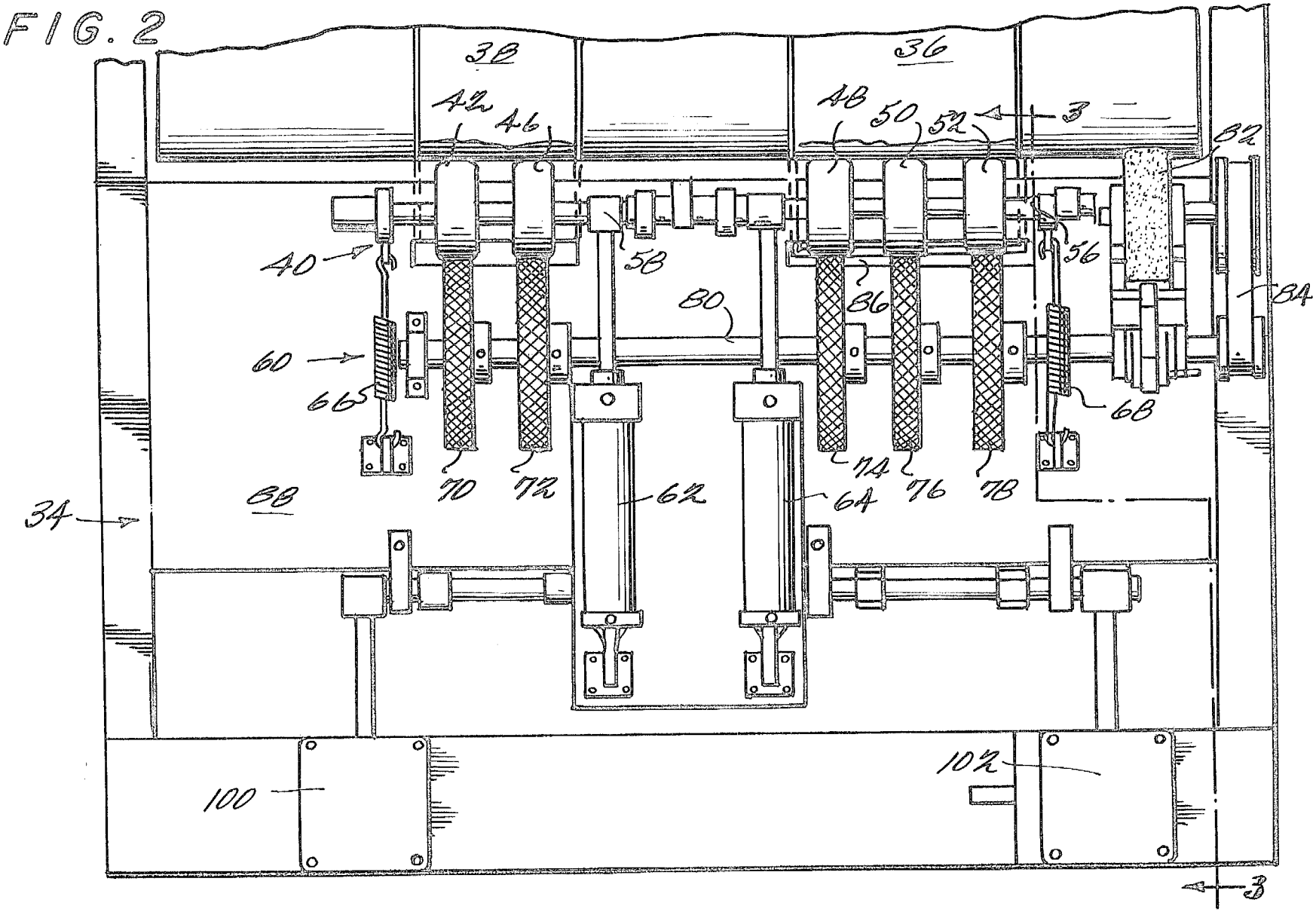
FIG. 2 shows a top view of the apparatus of the present invention.

Referring to FIG. 2 the two tapes 36 and 38 pass in front of a set of idler rollers 40 comprising individual rollers 42, 46, 48, 50 and 52. Idler rollers 40 are mounted about shafts 56 and 58 for rotation thereabout and shafts 56 and 58 are mounted for independent movement toward and away from power rollers 60 by respective air pistons 62 and 64. Springs 66 and 68 urge idler rollers 40 toward power rollers 60. Pistons 62 and 64 in their withdrawn position cause the idler rollers 40 to engage the driving power rollers 70, 72, 74 and 76 which are textured on their outer surface for gripping and advancing the tapes between the two sets of rollers 40 and 60. Rollers 60 are mounted for rotation about shaft 80 which is driven by wheel 82 which rotates in contact with pressure roller 24 and driving shaft 80 via belt 84. Suitable controls are provided adjacent the operator seat 22 for causing independent operation of pistons 62 and 64, preferably by electrically operated solenoid vales. The tapes driven between rollers 40 and 60 pass through slots 86 in horizontal plate 88 on which rollers 40 and 60 are mounted.

Figure 3:
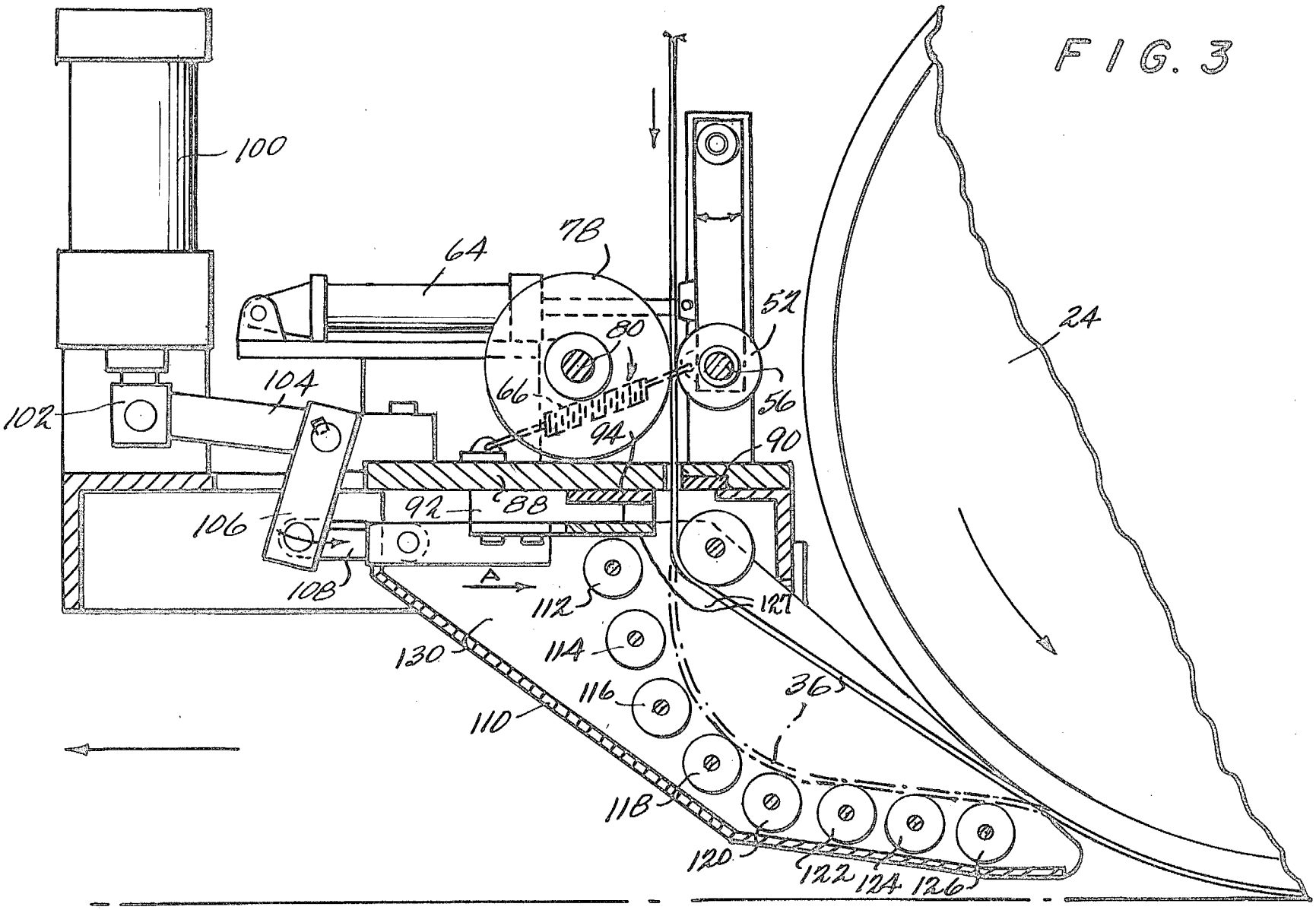
FIG. 3 shows a sectional view along the lines 3—3 showing the cutter mechanism and a guide chute.

Referring to FIG. 3, beneath plate 88 and adjacent slot 86 are provided for each tape a stationary, hardened steel, cutting blade 90 and slide 92 mounting a movable hardened steel, cutting blade 94. Only one of the cutters can be seen in FIG. 3. Either in response to manual operation of a control or in response to a counter as described below, slide 92 moves in the direction of arrow A as air cylinders or pistons 100 and 102 are actuated to move to their extended position and move blade 94 to a cutting position via a linkage comprising members 102, 104, 106 amd 108. The drive is disengaged prior to cutting the tape so that as soon as the plastic is cut it ends a stripe on the highway.

After passage between blades 90 and 94 each tape passes through a guide chute 110 which comprises rollers 112, 114, 116, 118, 120, 122, 124 and 126 and side plates 127 and 130 which convert the movement of the tape from the vertical to the horizontal and guide the tapes between the roadway and pressure roller 24. Only one chute 110 can be seen in FIG. 3.

Figure 4:
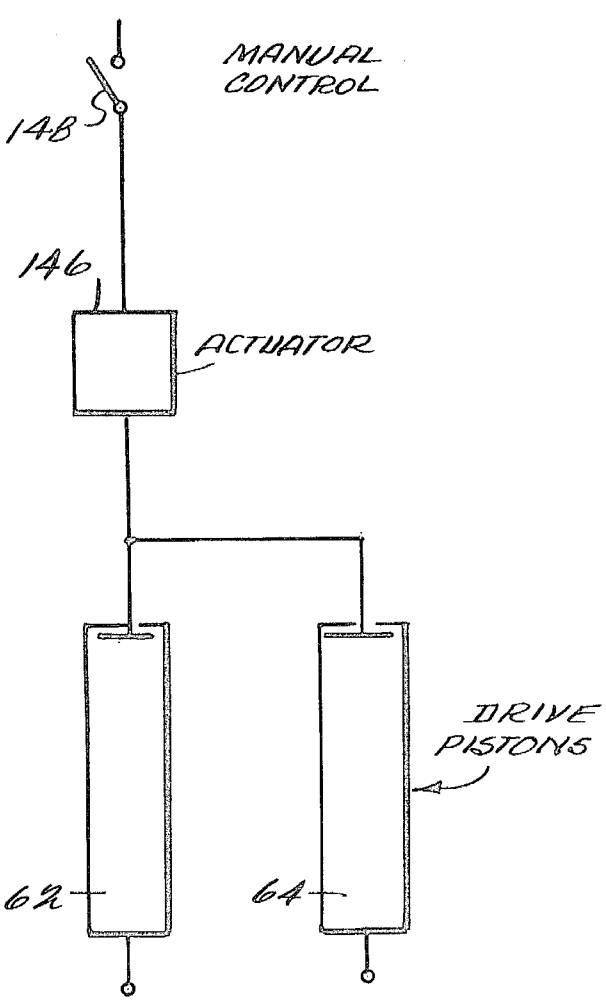
FIG. 4 shows a schematic view of the circuitry for controlling the cutter and driver pistons.
Figure 4:
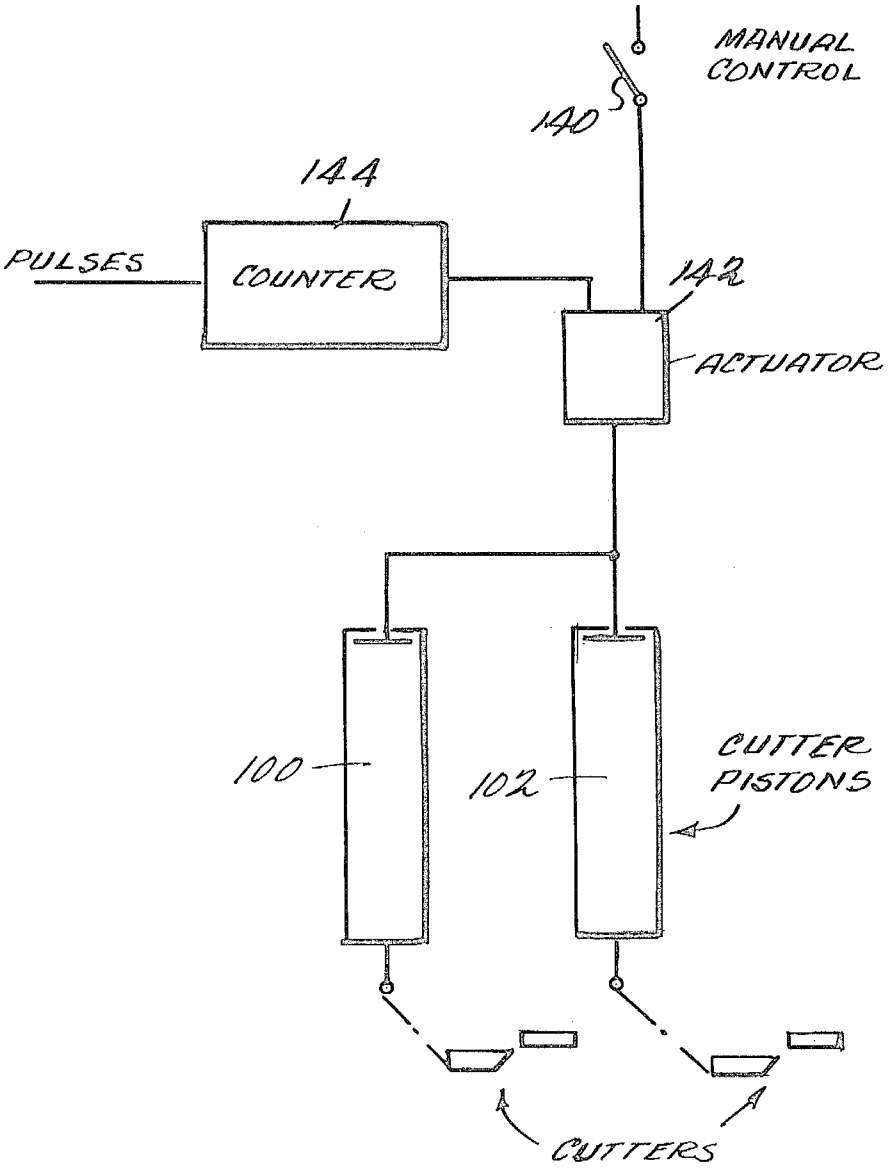

FIG. 4 shows a schematic for operating driver pistons 62 and 64 and cutter pistons 100 and 102. Pistons 100 and 102 can be operated by a manual control 140 which causes an actuator 142 such as a solenoid valve to actuate pistons 100 and 102. Alternatively actuator 142 may respond to the output of a conventional counter 144 which counts a given number of pulses—each indicating movement of the vehicle by a given distance. For example a typical skip line pattern on a highway might provide ten feet of plastic followed by a thirty foot space. The signal source for the counter can be a pulse generator mounted on a trailing wheel assembly at the rear of the vehicle. Such pulse generators are commonly used in this type of machine. Drive pistons 62 and 64 are actuated by actuator 146 in response to operation of control 148.

The air supply can be provided by a small air compressor and receiver which serves as a reservoir.

Many changes and modifications in the above described embodiment of the invention can of course be carried out without departing from the scope. While the present embodiment dispenses two tapes, it will be understood that any number can be layed down simultaneously. Accordingly, that scope is intended only to be limited by the scope of the appended claims.

What is claimed is:

1. An apparatus for mounting on a vehicle having a pressure roller and a plastic tape dispenser to apply plastic tape to pavement comprising:

a frame adapted for being mounted on said vehicle adjacent said pressure roller, including a horizontal plate having a slot through which said tape is advanced;

driving means mounted on said plate for engaging and advancing said tape in a first position and disengaged from said tape in a second position;

cutter means mounted on said frame beneath said plate adjacent said slot for actuation to cut said tape; and guide means mounted on said frame for guiding the tape between said pressure roller and the pavement.

2. An apparatus for mounting on a vehicle having at least one pressure roller and a plastic tape dispenser to apply plastic tape to pavement comprising:

a frame adapted to be mounted on said vehicle adjacent said roller, including a horizontal plate having a slot through which said tape is advanced;

driving means mounted on said plate for engaging and advancing said tape when actuated;

cutter means mounted on said frame beneath said plate adjacent said plate slot for cutting said tape when actuated; and guide means mounted on said frame for guiding said tape beneath said pressure roller as it is advanced by said driving means.

3. An apparatus for mounting on a vehicle having a front pressure roller and a plastic tape dispenser to apply plastic tape to pavement comprising:

a frame adapted for being mounted on the front of said vehicle adjacent said pressure roller including a horizontally extending plate having a slot through which said tape passes;

means mounted on top of said plate for driving said tape through said slot including a plurality of driving rollers, a driving shaft mounting said driving rollers for rotation, a wheel adapted to be mounted in contact with and rotated by said pressure roller, means coupling said wheel and said driving shaft for rotating said driving rollers, a plurality of idler rollers, a shaft mounting said idler rollers for rotation, at least one fluid operated piston for shifting said idler rollers from a first position in which said tape is engaged between said idler and driven rollers and advanced and a second position in which said tape is disengaged;

cutter means mounted beneath said plate adjacent said slot including a stationary knife, a movable knife, a fluid operated cutter piston mounted on said frame, and mechanical linkage between said piston and movable knife for causing said movable knife to cut said tape when said cutter piston is actuated; and a guide chute mounted beneath said plate for receiving tape passing through said slot including a plurality of rollers for guiding said tape between said pressure roller and the pavement.

4. An apparatus as in claim 1 or 2 wherein driving means includes a plurality of driving rollers, a driving shaft mounting said driving rollers for rotation, a wheel adapted to be mounted in contact with and rotated by said pressure roller, means coupling said wheel and said driving shaft for rotating said driving rollers, a plurality of idler rollers, a shaft mounting said idler rollers for rotation, at least one fluid operated driving piston for said shifting said idler rollers from a first position in which said tape is engaged between said idler and driven rollers and advanced and a second position in which said tape is disengaged.

5. An apparatus as in claim 1 or 2 wherein said cutter means includes a stationary knife, a movable knife, a fluid operated cutter piston mounted on said frame, and mechanical linkage between said piston and movable knife for causing said movable knife to cut said tape when said cutter piston is actuated.

6. An apparatus as in claim 1 or 2 wherein said guide means includes a chute for receiving tape passing through said slot and having a plurality of rollers for guiding said tape between said pressure roller and said pavement.

7. An apparatus as in claim 5 wherein said cutter means includes means for counting pulses indicating distance traveled by said vehicle, means for actuating said cutter piston upon a predetermined count and manually operable means for actuating said cutter piston.

8. An apparatus as in claim 5 wherein said driving means includes manually operable means for causing said driving piston to shift between said first and second positions.

9. A vehicle for applying plastic tape to pavement comprising:

a vehicle body;

a seat and operator controls on said body;

front and rear pressure rollers mounted for rotation on said body to move said vehicle;

a tape dispenser mounted on said body; and means mounted on said body adjacent said front roller for driving and cutting said tape and guiding said tape beneath said front roller including a frame mounted on said body, including a horizontal plate having a slot through which said tape is advanced, driving means mounted on said plate for engaging and advancing said tape when actuated, cutter means mounted on said frame beneath said plate adjacent said slot for cutting said tape when actuated, and guide means mounted on said frame for guiding said tape beneath said front roller as it is advanced by said driving means.

10. A vehicle as in claim 9 wherein said guide means includes a chute for receiving tape passing through said slot having a plurality of rollers for guiding said tape between said pressure roller and said pavement.

11. A vehicle as in claim 10 wherein said cutter means includes means for counting pulses indicating distance traveled by said vehicle, means for actuating said cutter piston upon a predetermined count and manually operable means for actuating said cutter piston.

12. A vehicle as in claim 9 wherein said driving means includes a plurality of driving rollers, a driving shaft mounted in contact with and rotated by said pressure roller, means coupling said wheel and said driving shaft for rotating said driving rollers, a shaft mounting said idler rollers for rotation, at least one fluid operated driving piston for shifting said idler rollers from a first position in which said tape is engaged between said idler and driving rollers and advanced and a second position in which said tape is disengaged.

13. A vehicle as in claim 12 wherein said driving means includes manually operable means for causing said driving piston to shift between said first and second positions.

14. A vehicle as in claim 9 wherein said cutter means includes a stationary knife, a movable knife, a fluid operated cutter piston mounted on said frame and mechanical linkage between said piston and movable knife to cut said tape when said cutter piston is actuated.

* * * * *